US005496194A

United States Patent [19]

Huss, Jr.

[11] Patent Number: 5,496,194

[45] Date of Patent: Mar. 5, 1996

[54] ELECTRICAL CONNECTOR WITH TWO STAGE LATCH HAVING IMPROVED RETAINING MEANS

[75] Inventor: John P. Huss, Jr., Harrisburg, Pa.

[73] Assignee: The Whitaker Corporation, Wilmington, Del.

[21] Appl. No.: 234,761

[22] Filed: Apr. 28, 1994

Related U.S. Application Data

[63] Continuation-in-part of Ser. No. 133,232, Oct. 4, 1993.

[51] Int. Cl.[6] ..... H01R 13/40

[52] U.S. Cl. ..... 439/595; 439/597

[58] Field of Search ..... 439/595, 596, 439/597, 598, 599, 600, 603, 350, 352, 271, 752, 753

[56] References Cited

U.S. PATENT DOCUMENTS

| | | | |
|---|---|---|---|
| 4,557,542 | 10/1985 | Coller et al. | 439/595 |
| 4,826,452 | 5/1989 | Sian et al. | 439/595 |
| 4,932,899 | 6/1990 | Sueyoshi et al. | 439/595 |
| 4,944,688 | 7/1990 | Lundergan | 439/275 |
| 4,973,268 | 11/1990 | Smith et al. | 439/595 |
| 5,292,261 | 3/1994 | Hirano et al. | 439/595 |

OTHER PUBLICATIONS

AMP Incorporated Publication; *AMP Universal Mate-N-Lok Connectors;* Jan. 10, 1989; p. 1.

*Primary Examiner*—P. Austin Bradley
*Assistant Examiner*—Hien D. Vu

[57] ABSTRACT

An electrical connector is disclosed having a movable contact retainer that cooperates with the connector housing to either retain or release the contacts. The retainer in movable from a closed position where the contacts are secured in place with respect to the connector housing and to an open position where the contacts are free to be removed for repair or replacement. A latch mechanism is provided that is operable from outside of the connector to move the contact retainer to either of its two positions. The latch mechanism includes a latch lever having a raised surface that, when depressed flush with a surface on the connector housing by means of a tool and pushed in the appropriate direction, is made to move from its closed position to its open position. The latch lever includes a camming surface that engages a portion of the connector housing to automatically cam the latch out of the way when moving in the opposite direction, therefore, the retainer can be returned to its closed position by simply pushing the extended retainer back into the housing.

10 Claims, 4 Drawing Sheets

ELECTRICAL CONNECTOR WITH TWO STAGE LATCH HAVING IMPROVED RETAINING MEANS

CROSS REFERENCE TO RELATED APPLICATION

This application is a continuation-in-part of prior co-pending application U.S. Ser. No. 08/133,232 filed Oct. 4, 1993.

The present invention relates to electrical connectors and latching mechanisms for retaining the contacts in the connector housing during use, including retaining means that is operable from outside of the housing to operate the latching mechanism for removing the contacts for repair.

BACKGROUND OF THE INVENTION

In the manufacture of electrical connectors various structures have been utilized to retain the contacts in the connector housing during use. Such structures must allow for the insertion of the contact into the connector housing during assembly yet resist forces that tend to pull the contacts out of the housing, for example, when the connector halves are separated. One of the most common retaining structures is a catch formed on the contact that is forced over a raised portion in the housing, the catch then snaps in place behind the raised portion to prevent removal of the contact. Other structures include a lance that is simply forced into a narrow cavity in the housing to provide a friction fit. All of these structures require a latch that will securely lock the catch or lance in place during use of the connector yet is operable to release the catch or lance to permit removal or insertion of contacts. Such structures usually require substantial disassembly of the connector to remove a damaged contact. A typical retaining structure that is known in the industry is disclosed in U.S. Pat. Nos. 4,973,268 and 4,944,688 which issued Nov. 27, 1990 and Jul. 31, 1990 respectively. The structure disclosed in these patents utilizes a pair of resilient members formed on a latch member that is secured to the connector housing. Each resilient member has mutually opposing projections that engage depressions formed on opposite sides of the contact. As the contact is pushed into the housing cavity during initial assembly, the contact engages the projections causing the resilient members to deflect outwardly. When the contact is fully seated the projections move into the depressions under the urging of the resilient members. A locking member is then inserted further into the housing to block outward deflection of the resilient members so that the projections are firmly locked in position within the depressions. The locking member includes its own retainer means that secures it to the housing so that when the connector is fully assembled the contacts cannot be removed. If a contact must be repaired the connector must be completely disassembled, which is usually quite difficult to do and occasionally, the retainer means for the locking member is damaged in the process.

What is needed is a contact retaining mechanism having a latch that is operable from outside of the connector to unlock the contacts for removal and repair and then to again lock the repaired contacts in position so that the connector can be returned to service. The latch should be easily accessible for manual operation yet protect against inadvertent unlocking.

SUMMARY OF THE INVENTION

An electrical connector is disclosed having a housing and a plurality of contacts in the housing. A retainer is provided that is movable in a first direction for retaining the contacts in the housing and movable in a second direction for releasing the contacts so that the contacts are removable from the housing. A retainer latch is associated with the retainer and includes an opening in the housing having a first enlarged portion and a necked down portion, and a latch attached to the retainer and resiliently biased into latching engagement with the first enlarged portion of the opening. The latch is manually moveable from outside the connector and arranged so that when depressed against the resilient bias and moved in the second direction a portion of the latch is moved into the necked down portion and the retainer is moved in the second direction thereby releasing the contacts.

DESCRIPTION OF THE PREFERRED EMBODIMENT

Figure 1:
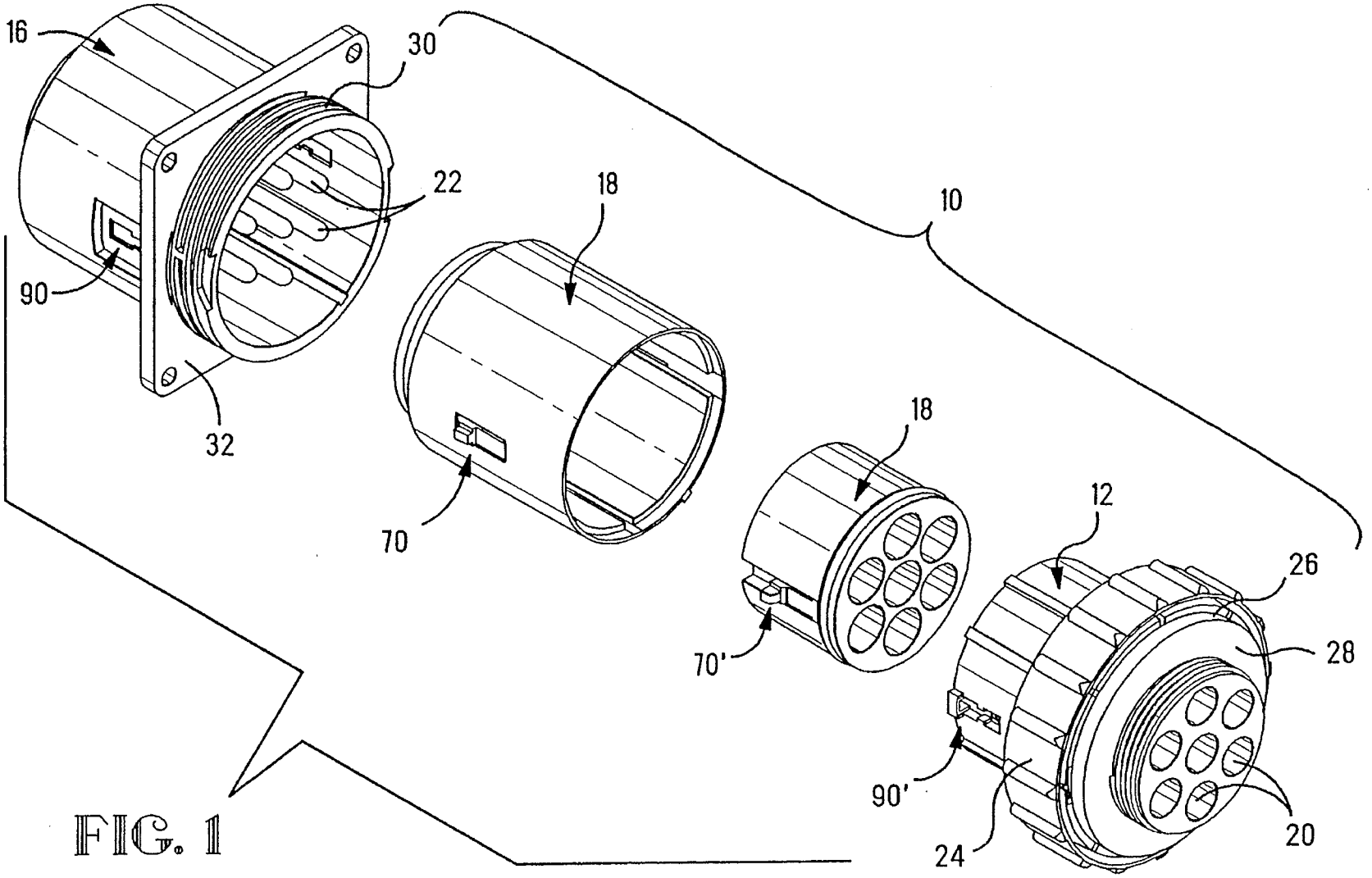
FIG. 1 is an exploded parts view of an electrical connector incorporating the teachings of the present invention.
Figure 2:
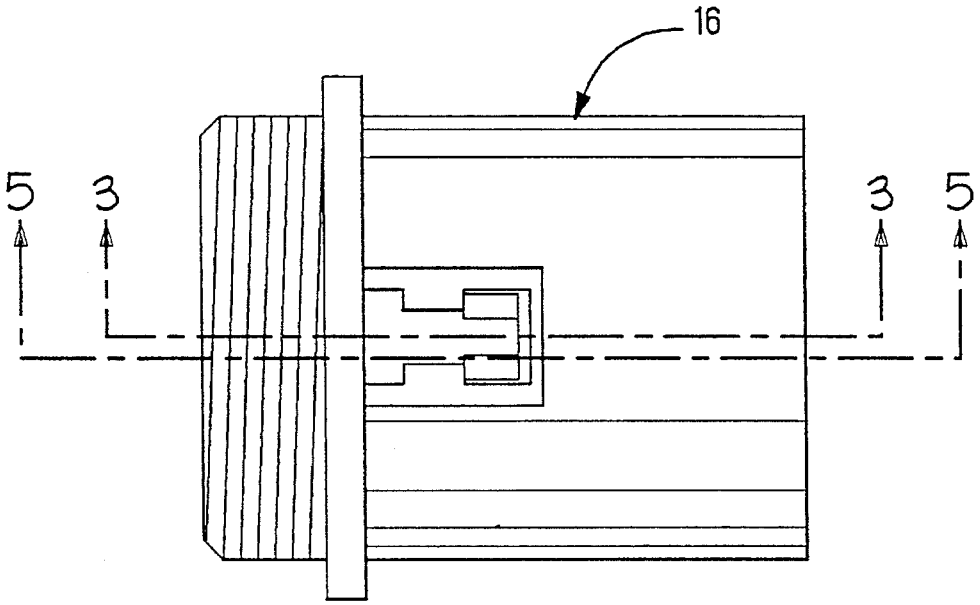
FIG. 2 is a top view of the receptacle connector half shown in FIG. 1.

There is shown in FIG. 1 a connector 10 having a plug housing 12, a plug contact retainer 14, a receptacle housing 16, and a receptacle contact retainer 18. The plug housing 12 contains a plurality of contact sockets 20 that receive and mate with a corresponding plurality of pins 22 contained in the receptacle housing 16. A threaded attachment ring 24 is arranged to rotate within a groove 26 formed in a peripheral flange 28 which is integral with the housing 12. The threads of the ring 24 mate with threads 30 formed on an extension of the receptacle housing 16 to lock the plug and receptacle together in mated engagement in the usual manner.

Figure 3:
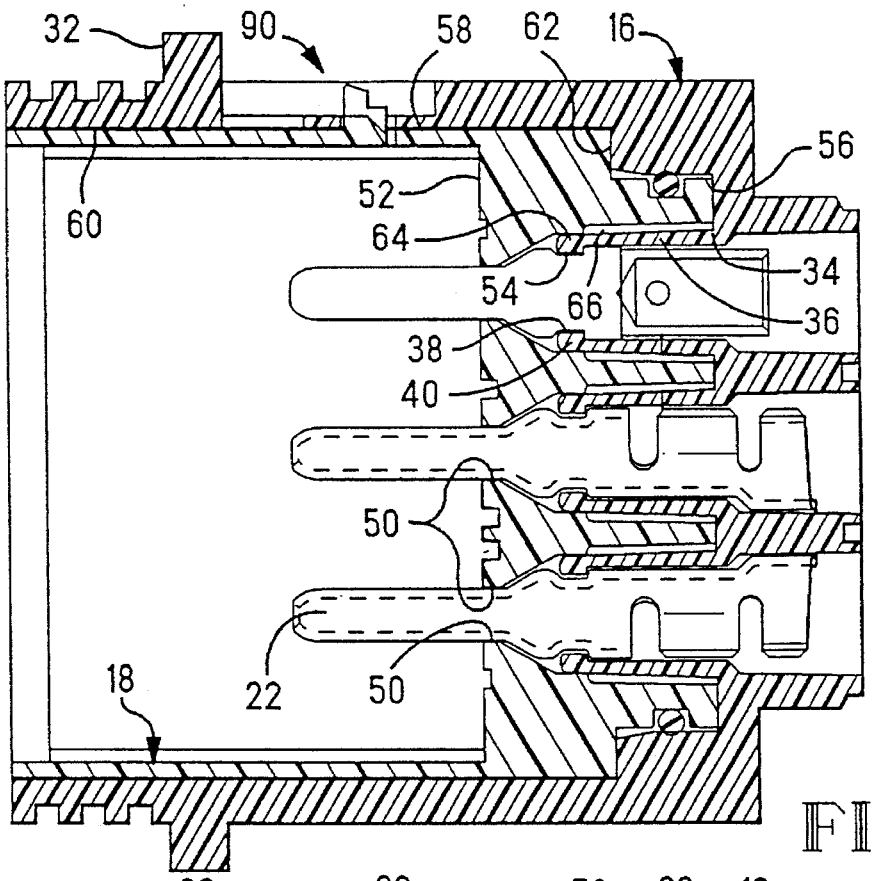
FIG. 3 is a cross-sectional view taken along the lines 3—3 of FIG. 2 showing the locking mechanism in its locked position.
Figure 4:
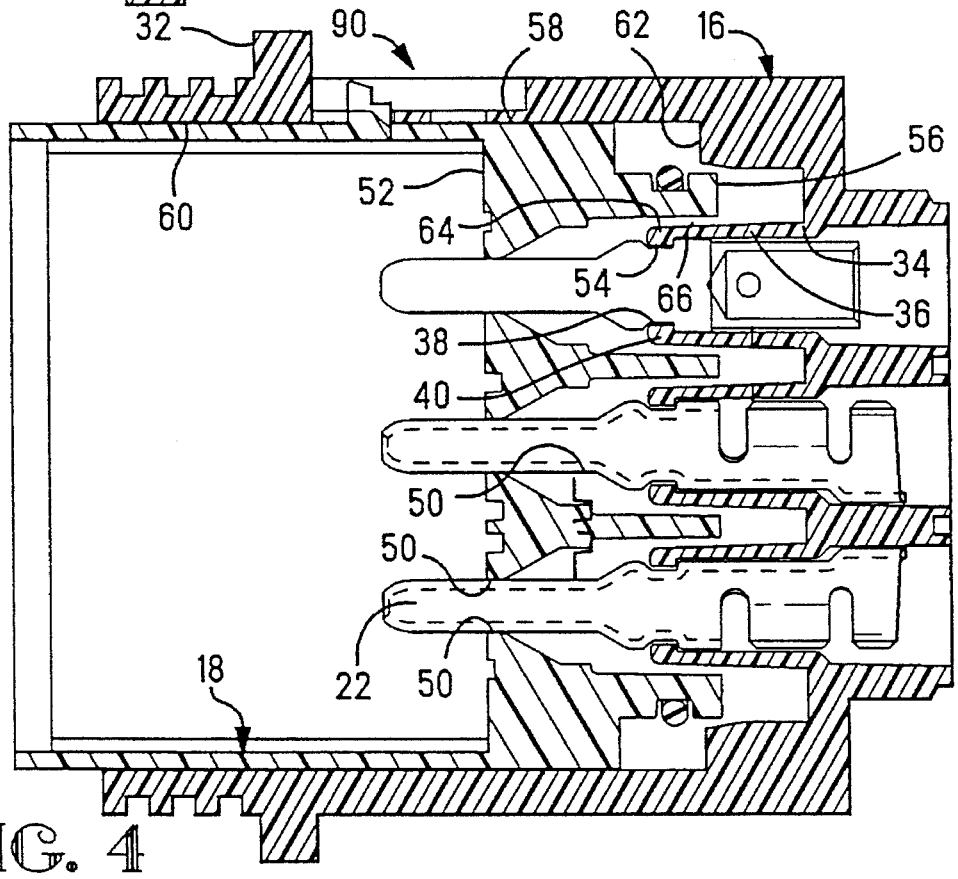
FIG. 4 is a cross-sectional view similar to FIG. 3 showing the locking mechanism in its unlocked position.

The receptacle housing 16 and receptacle contact retainer 18 function in a manner similar to that of the plug housing 12 and plug contact retainer 14 to retain their respective contacts within their housings, therefore, only the receptacle housing, receptacle contact retainer, and its contacts will be described. As shown in FIGS. 3 and 4, the receptacle housing 16 contains a plurality of contact pins 22 that mate with the contact sockets 20 contained in the plug housing 12. The receptacle housing 16 includes a mounting flange 32 for mounting to a panel. As best seen in FIG. 3, each contact 22 is held within a collet 34 formed integral with the housing 16. Each collet 34 includes several equally spaced resilient arms 36 that extend outwardly in the direction of the axis of the contact and completely surrounding it. Each resilient arm 36 includes a projection 38 projecting inwardly toward the contact 22. The contact 22 includes a depression 40 in the form of an annular ring in its outer surface. When the contacts 22 are fully seated within the receptacle housing 16, as shown in FIG. 4, the projections 38 are in the depression 40. The contact 22 may be removed from the receptacle housing 16 by simply pulling it rightwardly along its axis, as viewed in FIG. 4, so that the projection 38 cams outwardly out of the depression 40 and slides along the outer surface of the contact.

The receptacle contact retainer 18, as shown in FIG. 3 and 4, includes a plurality of openings 50 in alignment with the pins 22, each opening being sized at one end 52 to loosely receive the mating ends of the pins 22 and provided with a bore 54 at the other end 56 to slip over the collets 34 with little or no clearance. The outer diameter 58 of the contact retainer is sized to be a slip fit with the inside diameter 60 of the receptacle housing 16 so that the contact retainer is free to slide into and out of the receptacle housing. The diameter 60 terminates in a floor 62 within the receptacle housing 16. The contact retainer 18 can slide into the receptacle housing 16 until it is adjacent the floor 62. This is its closed and locked position. When in this position, as shown in FIG. 3, the walls of the bores 54 encircle the ends 64 of the arms 36 preventing them from moving outwardly thereby holding the projections 38 within the depression 40 and locking the contacts 22 within the receptacle housing. Each opening 50 at the end 56 has a counterbore 66 that extends to a depth that is less than the length of the collet 34. The receptacle contact retainer 18 can be moved away from the floor 62 to its open and unlocked position, as shown in FIG. 4. In this position the counterbores 66 now extend past the ends 64 of the arms 36 so that the contacts 22 can be moved toward the right along their axes, as viewed in FIG. 4. Such movement will cause the projections 38 to cam up and out of the depressions 40, the arms 36 deflecting into the space provided by the counterbores 66.

Figure 5:
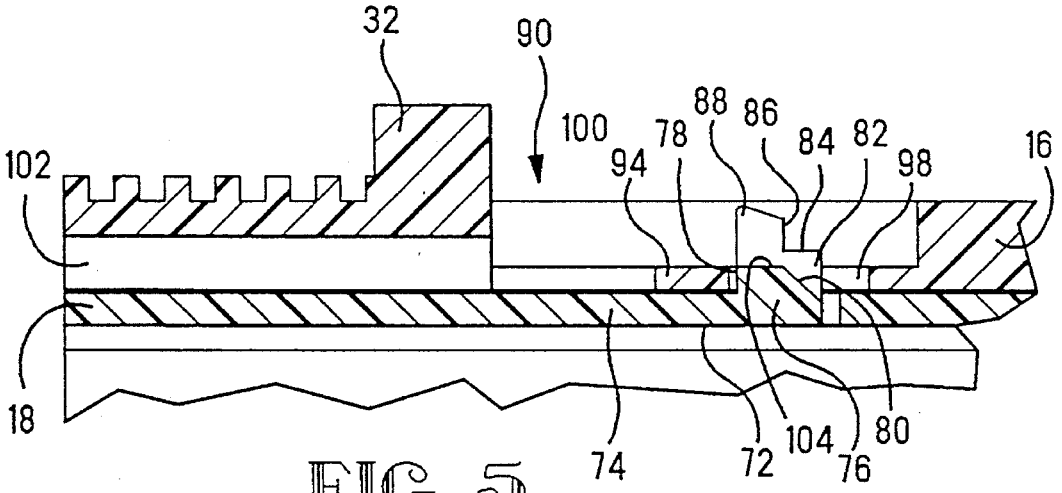
FIG. 5 is an enlarged partial cross-sectional view taken along the lines 5—5 of FIG. 2 showing the latch.
Figure 6:
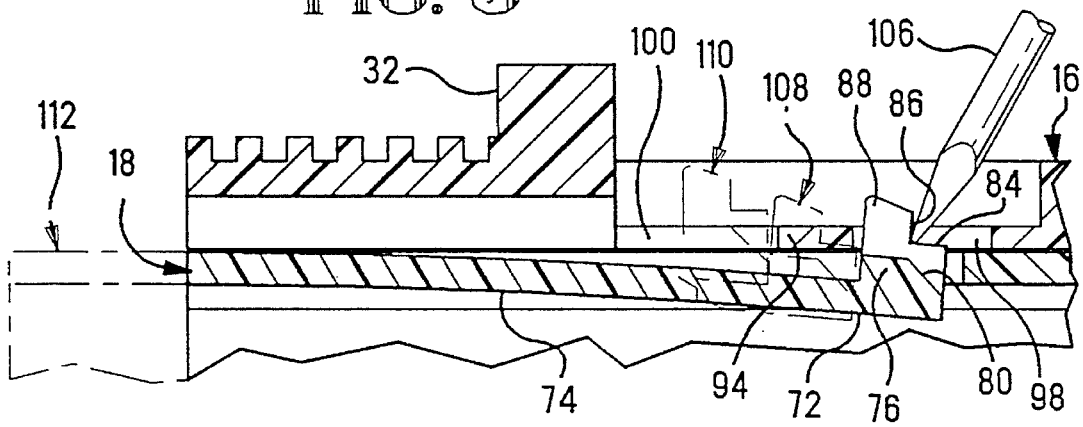
FIG. 6 is a view similar to that of FIG. 5 showing the latch in various operational positions.
Figure 7:
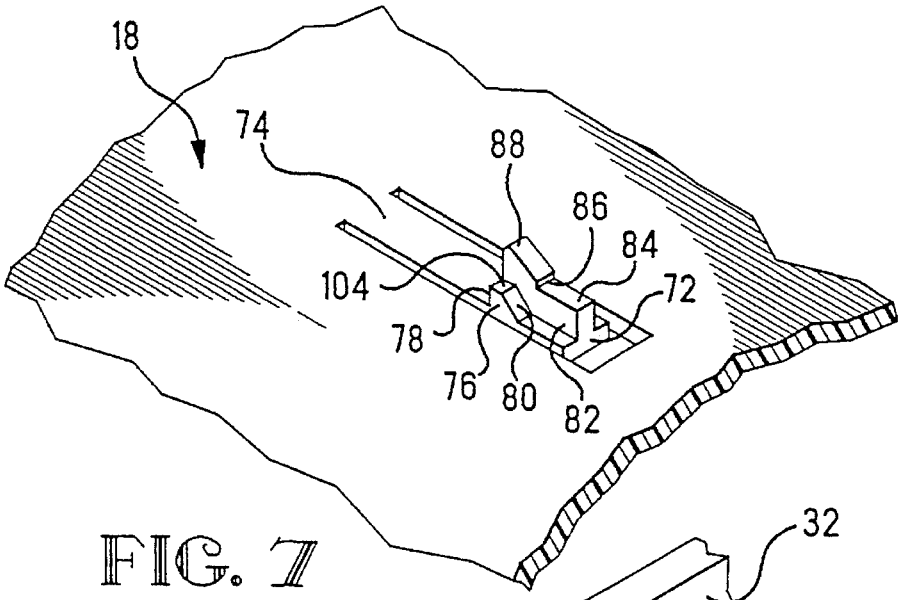
FIG. 7 is an isometric view of a portion of the receptacle contact retainer showing the latch.

The movement of the receptacle contact retainer 18 between its open and closed positions is controlled by a pair of latch mechanisms 70, one of which is shown in FIGS. 5, 6, and 7, that are spaced 180 degrees apart, in the present example. Each of the latch mechanisms 70 includes a latch lever 72 having a resilient member 74 attached at one end thereof to the receptacle contact retainer 18 that biases the latch lever upwardly to the position shown in FIG. 5. The latch lever 72 includes a catch 76 having an abutting shoulder 78 and a camming surface 80. A raised portion 82 extends upwardly from the center of the latch lever 72 so that the catch 76 is disposed on both sides thereof. The raised portion 82 has an upwardly facing surface 84 terminating in a shoulder 86, and a retaining arm 88 extending above the surface 84.

Figure 8:
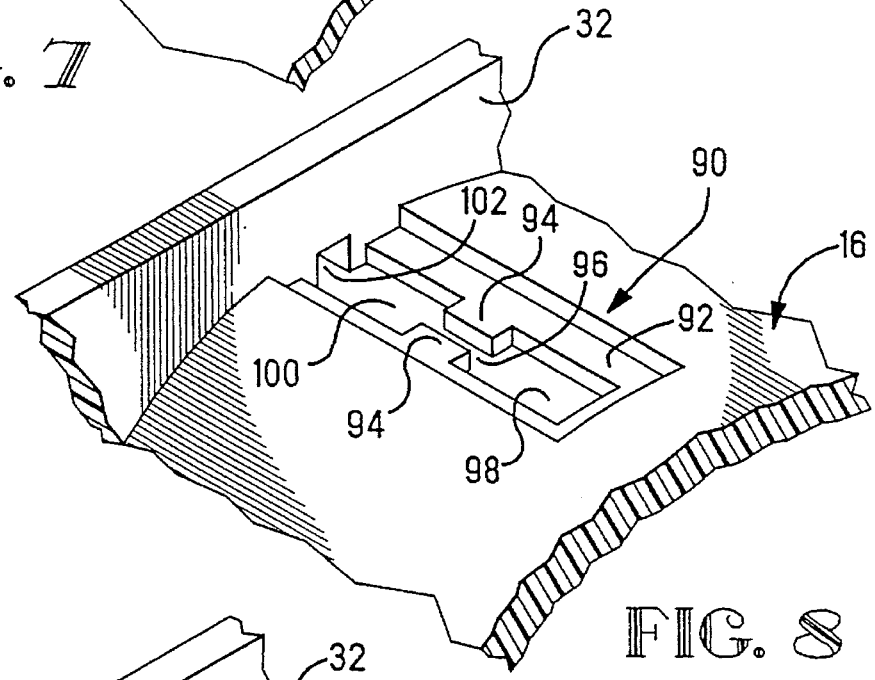
FIG. 8 is an isometric view of a portion of the receptacle housing showing the latch opening.

As best seen in FIGS. 5 and 8, there is an opening 90 through the wall of the receptacle housing 16 for receiving the latch lever 72. In the present example, there are two such openings spaced diametrically opposite to accommodate the two latch levers 72. Note that the opening 90 and latch lever 72 are recessed below the outer surface of the receptacle housing 16. This is aids in providing manual access to the handle 188 while keeping the outer profile of the receptacle obstruction free. Additionally, at least one of the recesses is relatively narrow so that its latch is not easily accessible without a tool, to prevent inadvertent release during handling. The recess has a floor 92 that extends from an end of the opening adjacent the mounting flange 32, completely around the opening 90. There are a pair of opposing protrusions 94 within the opening 90, about midway along the length thereof, thereby providing a necked down opening 96 that is just wide enough to permit passage of the raised portion 82 therebetween but not the catch 76. The opening 90 includes a first enlarged portion 98 and a second enlarged portion 100 both of which are sized to receive the catch 76 of the latch lever 72. A groove 102 is disposed in the inside diameter 60 of the receptacle housing 16 beginning at the flange 32 and continuing to the end of the housing having the threads 30. This groove permits passage of the arm 88 during assembly of the contact retainer 18 to the receptacle housing 16.

The surface 84 of the raised portion 82 is spaced vertically above a top surface 104 of the catch 72, while the floor 92 of the opening 90 is recessed below the outer surface of the housing 16 sufficiently so that the protrusions 94 have a thickness that is slightly less than the distance between the surfaces 84 and 104. Therefore, when the latch lever 72 is depressed by a blade 106 of a screw driver being inserted in the notch formed by the surface 84 and shoulder 86 and urged downwardly until the blade engages the floor 92 of the opening 90, as best seen in FIG. 6, the catch 76 is vertically below the protrusions 94. In this position, shown in solid lines in FIG. 6, the blade 106 may be pushed to the left thereby moving the latch lever 72 and attached contact retainer 18 to the left, causing the raised portion 82 to enter into the necked down opening 96, as shown in phantom lines at 108. Leftward movement continues until the latch lever 72 is on the other side of the protrusions 94, at which time the blade 106 is removed and the latch lever is urged upwardly into the second enlarged opening 100 by the upward bias of the resilient member 74 to the position shown in phantom lines at 110. Leftward movement of the latch lever 72 is limited by the arm 88 which will engage the flange 32 if the latch lever is pushed too far to the left, thereby maintaining the contact retainer 18 in captive engagement with the receptacle housing 16. Note that the end of the contact retainer 18 extends leftwardly to the position shown in phantom lines at 112 in FIG. 6. This is the open position of the latch mechanism 90 with the contact retainer 18 in its open position shown in FIG. 4. In this position the contacts 22 are free to be removed by urging them rightwardly along their axes so that the projections 38 cam outwardly out of the depressions 40 and slide along the outer surface of the contact as the contact is being removed. When it is desired to lock the contacts in place within the receptacle housing 18, the extended end of the contact retainer 18, shown at 112 in FIG. 6, is pushed into the receptacle housing 16, thereby causing the angled cam surface 80 to engage the protrusions 94 and cam downward so that the catch 76 is below and out of abutting alignment with the protrusions. As movement continues, the raised portion 82 passes through the necked down opening 96 and then snaps upwardly into the first enlarged portion 98 under the urging of the resilient member 74 to the position shown in FIG. 5. In this position the resilient member 74 holds the catch 76 of the latch lever 72 within the opening 98 and the protrusions 94 are in abutting alignment with the shoulder 78 of the catch to maintain the latch lever in the closed position so that the contact retainer 18 is in its closed position, as shown in FIG. 3, and the contacts 22 are locked in position with respect to the receptacle housing 16. The depth of the floor 92 of the recess and the width of the recess are chosen so that the arm 88 is not readily accessible, for example by a persons' finger, to minimize inadvertent actuation of the latch mechanism during routine handling of the connector. Alternatively, the latch mechanism that is opposite the latch mechanism 70 may have a latch lever that is easily operable by means of a finger, in a manner similar to that described for the latch 70.

With such a structure inadvertent operation of the latch system would still be prevented by the one latch 70, yet would allow for easier simultaneous operation of both latches by one person.

Figure 9:
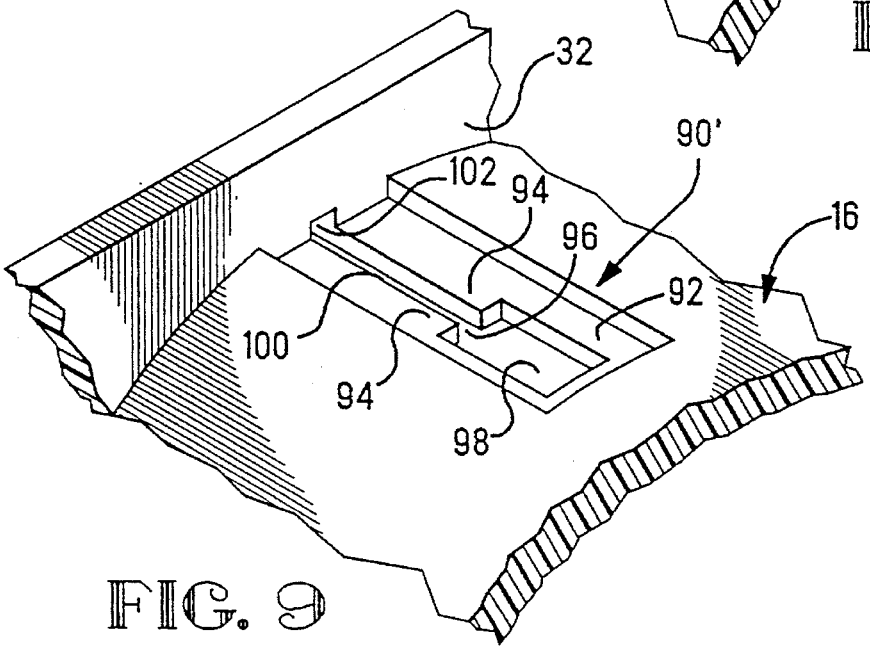
FIG. 9 is a view similar to that of FIG. 8 showing an alternative embodiment.

An alternative embodiment of the opening 90 in the receptacle housing is shown in FIG. 9. There it will be seen that the opening 90' is substantially similar to the opening 90 except that the second enlarged portion 100 is not present. In this case the necked down opening 96 extends from the first enlarged portion 98 to the groove 102 in the flange 32. When the latch lever 72 is depressed by the blade 106, as described above, and moved toward its open position to the left, as viewed in FIG. 6, the catch 76 simply stays below the protrusions 94. The contact retainer 18 releases the contacts in the same manner as described above. A possible disadvantage with this embodiment is that the latch 70 may be inadvertently moved to its closed and latched position prior to completion of repairs. Therefore, it is preferable to utilize the opening 90 shown in FIG. 8.

The latch mechanism 70 and opening 90 have been described with respect to the receptacle housing 16 and its contact retainer 18. However, it will be understood that a similar latch mechanism 70' and opening 90', as shown in FIG. 1, may be utilized to move the contact retainer 14 from its closed and locked position where the contacts 20 are secured with respect to the plug housing 12, to its open position where the contacts are free to be removed.

In the present example, the entire connector 10, except the contacts, is made of plastic, including the receptacle and plug housings, the plug coupling ring, and the two contact retainers, however, any suitable material may be used. It will be understood that, while collets 34 having projections 38 that engage depressions 40 in the contacts 22 have been utilized to retain the contacts in position with respect to the receptacle housing, other contact retaining structures may be advantageously utilized with the latch mechanism of the present invention.

An important advantage of the present invention is that the unique latch mechanism is operable from outside of the connector without disassembly of the connector. This aids in the relatively quick and inexpensive repair of damaged contacts in the field. Additionally, the unique structure of the catch and raised portion of the latch lever, being spaced from the floor of the opening so that depression by a screw driver until it is flush with the floor, automatically positions the catch out of abutting alignment with the necked down portion of the opening without overstressing the resilient member 74.

I claim:

1. An electrical connector having:

(a) a housing;

(b) a plurality of contacts insertable in a first direction into said housing;

(c) a retainer movable in a second direction opposite to say first direction for retaining said contacts in said housing and movable in said first direction for releasing said contacts so that said contacts are removable from said housing; and (d) a retainer latch associated with said retainer comprising:

an opening in said housing extending through a floor of a recess in an outer surface of said housing and having a first enlarged portion and a necked down portion of said opening; and a latch attached to said retainer and resiliently biased into latching engagement with said first enlarged portion of said opening upon movement of said retainer in said second direction into a latched position to retain said contacts in said housing, said latch being manually movable from said outer surface of said housing and arranged so that when said latch is depressed in opposition to said resilient bias and moved in said first direction, a portion of said latch is moved from said first enlarged portion into said necked down portion of said opening and said retainer is moved in said first direction thereby releasing said contacts.

2. The connector according to claim 1 wherein said latch includes a catch that is in abutting alignment with said necked down portion of said opening when said latch is in latching engagement in said first enlarged portion of said opening.

3. The connector according to claim 2 wherein said latch includes a raised portion that extends past said catch, through said opening and beyond said floor, said raised portion being arranged so that when said latch is depressed in opposition to said resilient bias to a position substantially flush with said floor, said catch is out of said abutting alignment.

4. The connector according to claim 3 wherein said raised portion has a width that is smaller than said necked down portion of said opening so that when said latch is depressed in opposition to said resilient bias and moved in said second direction, said raised portion moves into said necked down portion of said opening.

5. An electrical connector having:

(a) a housing;

(b) a plurality of contacts insertable in a first direction into said housing;

(c) a retainer movable in a second direction opposite to said first direction for retaining said contacts in said housing and movable in said first direction for releasing said contacts so that said contacts are removable from said housing; and (d) a retainer latch associated with said retainer comprising:

an opening in an outer surface of said housing, said opening having a first enlarged portion, a second enlarged portion, and a necked down portion arranged so that said necked down portion of said opening is disposed between said first and second enlarged portions; and a latch attached to said retainer and resiliently biased into latching engagement with said first enlarged portion of said opening upon movement of said retainer in said second direction into a latched position to retain said contacts in said housing, said latch being manually movable from said outer surface of said housing and arranged so that when said latch is depressed in opposition to said resilient bias and moved in said first direction a portion of said latch is moved from said first enlarged portion into said necked down portion of said opening and said retainer is moved in said first direction thereby releasing said contacts, and as said latch is further moved in said first direction, said portion of said latch moves past said necked down portion of said opening and said latch is urged into latching engagement with said second enlarged portion of said opening by said resilient bias.

6. The connector according to claim 5 wherein said latch includes a catch that is in abutting alignment with said necked down portion of said opening when said latch is in engagement with either of said first and second enlarged portions of said opening and said latch includes a camming surface arranged so that when said latch is in engagement with said second enlarged portion of said opening and is moved in said second direction, said camming surface engages said neck down portion of said opening and deflects away therefrom in opposition to said resilient bias so that said catch is out of abutting alignment with said necked down portion of said opening.

7. The connector according to claim 6 wherein said latch includes a raised portion having an outside surface that extends past said catch, through and beyond said opening so that when depressed until said outside surface is substantially even with an outer edge of said opening said catch is out of abutting alignment with said necked down portion of said opening.

8. The connector according to claim 7 wherein said raised portion has a width that is smaller than said necked down portion of said opening so that when said latch is depressed in opposition to said resilient bias and moved in said first direction, said raised portion moves into said necked down portion of said opening.

9. The connector according to claim 5 wherein said second enlarged portion of said opening has an end opposite said necked down portion of said opening and said latch includes an arm that extends upwardly therefrom through and beyond said opening so that when said latch is moved in said first direction a sufficient amount, said arm engages said end thereby preventing separation of said retainer from said housing.

10. An electrical connector having:

(a) a housing;

(b) a plurality of contacts insertable in a first direction into said housing;

(c) a retainer movable in second direction opposite to said first direction for retaining said contacts in said housing and movable in said first direction for releasing said contacts so that said contacts are removable from said housing, said retainer remaining captive within said housing when moved in said first and second directions; and (d) a retainer latch associated with said retainer comprising:

an opening in said housing having a first enlarged portion and a necked down portion of said opening; and a latch attached to said retainer and resiliently biased into latching engagement with said first enlarged portion of said opening upon movement of said retainer said second direction into a latched position to retain said contacts in said housing, said latch being manually movable from said outer surface of said housing and arranged so that when latch is depressed in opposition to said resilient bias and moved in said first direction, a portion of said latch is moved from said first enlarged portion into said necked down portion of said opening and said retainer is moved in said first direction thereby releasing said contacts.

* * * * *